US005122337A

United States Patent [19]

Lund et al.

[11] Patent Number: 5,122,337

[45] Date of Patent: Jun. 16, 1992

[54] STEEL INTENDED FOR HIGHLY STRESSED STRUCTURAL MEMBERS WITH HIGH DEMANDS FOR DUCTILITY AND FATIGUE RESISTANCE

[75] Inventors: Thore Lund; Hans-Ake Munther, both of Hofors, Sweden

[73] Assignee: Ovako Steel, AB, Hofors, Sweden

[21] Appl. No.: 634,065

[22] Filed: Dec. 26, 1990

Related U.S. Application Data

[63] Continuation-in-part of Ser. No. 283,544, Dec. 13, 1988, abandoned.

[30] Foreign Application Priority Data

Feb. 9, 1988 [SE] Sweden ..... 8800411

[51] Int. Cl.[5] ..... C22C 38/12

[52] U.S. Cl. ..... 420/123; 420/87

[58] Field of Search ..... 420/101, 8, 100, 87, 420/110, 123; 148/320, 334, 335

[56] References Cited

U.S. PATENT DOCUMENTS

| | | | |
|---|---|---|---|
| 1,355,589 | 10/1920 | Charls | 420/125 |
| 1,355,590 | 12/1920 | Charls | 420/123 |
| 1,963,403 | 6/1934 | Daniels | 420/123 |
| 2,158,036 | 5/1939 | Pavitt | 420/123 |
| 2,413,602 | 12/1946 | Bonte | 420/123 |
| 3,155,550 | 11/1964 | Mitchell et al. | 420/123 |
| 4,225,365 | 9/1980 | Rice | 420/123 |

FOREIGN PATENT DOCUMENTS

| | | |
|---|---|---|
| 552128 | 5/1933 | Fed. Rep. of Germany . |
| 856089 | 6/1939 | France . |
| 59-23849 | 2/1984 | Japan . |
| 55-134155 | 10/2980 | Japan . |
| 7311 | 7/1885 | Sweden . |
| 279490 | 5/1928 | United Kingdom . |
| 414264 | 8/1934 | United Kingdom . |
| 457872 | 3/1935 | United Kingdom . |
| 511735 | 8/1939 | United Kingdom . |
| 552631 | 3/1942 | United Kingdom . |
| 654776 | 6/1947 | United Kingdom . |
| 1355258 | 6/1974 | United Kingdom . |
| 1428584 | 6/1974 | United Kingdom . |
| 1368917 | 10/1974 | United Kingdom . |
| 1580686 | 12/1980 | United Kingdom . |

*Primary Examiner*—Deborah Yee

*Attorney, Agent, or Firm*—Ostrolenk, Faber, Gerb & Soffen

[57] ABSTRACT

Steel is described which is improved by dissolving components of the steel that oppose its workability into a ferrite phase of the steel, and by combining components of the steel that impart desirable properties to it with carbon to form carbides. The steel is useful for highly stressed structural members.

13 Claims, No Drawings

STEEL INTENDED FOR HIGHLY STRESSED STRUCTURAL MEMBERS WITH HIGH DEMANDS FOR DUCTILITY AND FATIGUE RESISTANCE

This application is a continuation-in-part application of application Ser. No. 283,544, filed Dec. 13, 1988, now abandoned.

The present invention relates to steel, particularly for highly stressed structural members with high demands for ductility and fatigue resistance described in the preamble to claim 1, and to the use of such types of steel.

The steel claimed can be utilized with advantage for structural members of the type mentioned and has properties well suited to the manufacture and machining of such structural members.

In conventional manner, the carbon content in the steels according to the invention is adjusted according to the specific area of application. However, characteristic of these steels is primarily that the only intentional (alloying) additive is molybdenum, whereas the other alloying materials normally used are limited to the smallest normal levels for the steel manufacturing processes. We believe that the steels thus acquire a structure which is maximally workable since those elements which oppose workability by dissolving into the ferrite phase of the steel are avoided, whereas those elements which give the final product the desired properties, are deposited in carbide form and only released when required, that is when the steel is being hardened.

Structural members for which the steels claimed are particularly suitable are toothed gears, shafts, other transmission components, valve springs and roller bearing elements. The types of steels referred to are case-hardening steel, heat-treatable steel, induction hardening steel, spring steel and roller bearing steel The composition areas referred to for C and Mo are divided into four corresponding groups:

0 10–0.35% C and 0.20–1.00% Mo
0.35–0.60% C and 0.20–1.00% Mo
0.60–0.85% C and 0.20–1.00% Mo
0.85–1.15% C and 0.20–1.00% Mo Other elements shall preferably be maintained within the following limits:

All alloying materials—Si, Mn, Cr, Ni, V, W and others shall be present in quantities not greater than is typical for residual contents for the industrial manufacturing process being used for the steel in question. Normal residual contents shall be no more than is typical for residual contents for the steel manufacturing process used. This is applicable except with respect to the contents of S, Ti and O.

The S content shall be adjusted to the area of application of the steel; for the area of application in which plastic shaping is the primary shaping operation for the steel, the S content shall be max. 0.015%. if the primary form of treatment for the steel is to be cutting, then the S content shall be within the interval 0.010%–0.025%. If the demands for cuttability are extremely high for the steel, the S content may be as much as 0.080%.

As far as titanium is concerned, the Ti content shall preferably always be limited to at most 50 ppm.

Considering the oxygen content, this should preferably always be limited to at most 20 ppm.

The invention thus describes steels which are especially suitable for highly stressed structural members, particularly those with high demands for ductility and fatigue resistance. The invention also relates to the use of these steels for the general and specific applications stated and for equivalent applications. As will be appreciated by anyone skilled in the art, the intervals and limits stated offer inherent advantages even if not all these advantages are presented here.

The steels claimed are thus particularly well suited for use in highly stressed structural members with high demands for ductility and fatigue resistance, particularly if the structural member is to be hardened after shaping (either by cutting or plastic forming).

In a preferred embodiment of the invention, the steel includes the following residual components: up to about 0.10% silicon, up to about 0.20% manganese, up to about 0.15% chromium and up to about 0.15% nickel. Other residual elements, which are unimportant to the principles of the invention, may be present in the steel. These elements include, but are not limited to, vanadium, tungsten, sulfur, titanium and oxygen. The ferrite phase of the steel preferably includes up to about 100% of the silicon present in the steel, up to about 85% of the manganese present in the steel, up to about 20% of the chromium present in the steel and up to about 100% of the nickel present in the steel. Remaining parts of these elements as well as all carbon, resides in the carbide phase.

Steel in accordance with the invention, and in particular, in accordance with the preferred embodiment described above, satisfies high demands for ductility and fatigue resistance. The elements which are dissolved in the ferrite phase of the steel are the elements which oppose workability of the steel. These elements are dissolved in the ferrite phase in low amounts to substantially avoid reducing the ductility and fatigue resistance of the steel. The elements which are present in carbide form impart high ductility and fatigue resistance to the steel. These elements are released when the steel is hardened.

The example below illustrates preparation of the steel in accordance with the principles of the invention, and sets forth an analysis of the steel including a list of the residual elements present.

EXAMPLE

Typically, steel of the above described is produced by melting (in an electric arc furnace or in an oxygen bloom converter process), tapping of the melt into a ladle furnace where deoxidation, refining, alloying and temperature adjustment is performed prior to teeming into ingots, or continuous casting into blooms or billets.

As an example, one heat of steel produced by the EAF Ladle furnace ingot casting route obtained the following chemical composition:

Heat No: C9631
C 0.76%
Si 0.02%
Mn 0.19%
P 0.005%
S 0.014%
Cr 0.05%
Ni 0.04%
Mo 0.47%
Ti 6 ppm
O 10 ppm Various changes and modifications can be made in the present invention without departing from the spirit and scope thereof. The embodiment which has been described herein was for the purpose of illustrating the invention but was not intended to limit it.

What is claimed is:

1. Steel having high ductility and fatigue resistance consisting essentially of iron, 0.1 to 1.15 percent carbon, 0.2 to 1.0 percent molybdenum, and residual chemical elements, the residual elements comprising up to about 0.10 percent silicon, up to about 0.20 percent manganese, up to about 0.15 percent chromium and up to about 0.15 percent nickel, whereby the residual chemical elements present in said steel which oppose workability are dissolved in the ferrite phase of said steel in low amounts to substantially avoid reducing the ductility and fatigue resistance thereof, and elements which impart high ductility and fatigue resistance to said steel are present in said steel in carbide form to be released when said steel is hardened.

2. The steel of claim 1, wherein said carbon is present in an amount between 0.1 and 0.35 percent.

3. The steel of claim 1, wherein said carbon is present in an amount between 0.35 and 0.60 percent.

4. The steel of claim 1, wherein said carbon is present in an amount between 0.60 and 0.85 percent.

5. The steel of claim 1, wherein said carbon is present in an amount between 0.85 and 1.15 percent.

6. The steel of claim 1, wherein said residual chemical elements further comprise sulfur in an amount between 0.01 and 0.08 percent.

7. The steel of claim 6, wherein said sulfur is present in an amount between 0.01 and 0.025 percent.

8. The steel of claim 6, wherein said sulfur is present in an amount not more than 0.015 percent.

9. The steel of claim 1, wherein said residual chemical elements comprise titanium in an amount not more than 50 ppm.

10. The steel of claim 9, wherein said residual chemical elements also comprise oxygen in an amount not more than 20 ppm.

11. The steel of claim 10, wherein said residual chemical elements also comprise sulfur in an amount between 0.01 and 0.08 percent.

12. The steel of claim 1, wherein said residual chemical elements comprise oxygen in an amount not more than 20 ppm.

13. The steel of claim 1, wherein said ferrite phase includes up to about 100 percent of said silicon present in the steel, up to about 85 percent of said magnesium present in said steel, up to about 20 percent of said chromium present in said steel and up to about 100 percent of said nickel present in said steel.

* * * * *